United States Patent [19]

Lee

[11] Patent Number: 4,741,055

[45] Date of Patent: May 3, 1988

[54] FUR SHAWL

[75] Inventor: Joung-Ho Lee, Seoul, Rep. of Korea

[73] Assignee: Sam Yang Fur Co., Ltd., Rep. of Korea

[21] Appl. No.: 36,008

[22] Filed: Apr. 8, 1987

[30] Foreign Application Priority Data

Apr. 9, 1986 [KR] Rep. of Korea ..... 86-4541

[51] Int. Cl.[4] ..... A41D 5/00

[52] U.S. Cl. ..... 2/65; 112/401

[58] Field of Search ..... 2/65, 66, 88; 112/401; 69/22

[56] References Cited

U.S. PATENT DOCUMENTS

| | | | |
|---|---|---|---|
| 364,617 | 6/1887 | Wolff | 2/65 |
| 2,483,236 | 9/1949 | Rona | 112/401 |
| 3,717,246 | 2/1973 | Cuddeback | 112/401 X |

FOREIGN PATENT DOCUMENTS

| | | | |
|---|---|---|---|
| 1143007 | 9/1957 | France | 2/65 |

*Primary Examiner*—Louis K. Rimrodt
*Assistant Examiner*—Judith L. Olds
*Attorney, Agent, or Firm*—Handal & Morofsky

[57] ABSTRACT

A fur covering comprising a fur material made of new fur or particularly even waste pieces form cutting furs, a net into which string may be knitted or wound and which has elasticity, and a sewing thread. In accordance with the invention process for making a fur covering such as a shawl, the fur material is rolled round each side of the net and concurrently, is sewed up round each side of the net with the sewing thread and thereby, these are formed into a united body and become the fur shawl.

11 Claims, 1 Drawing Sheet

FUR SHAWL

BACKGROUND OF THE INVENTION

1. Field of the Invention

The present invention relates to a fur covering and, more particularly, a fur shawl made of fur material and a net.

2. Description of the Prior Art

A fur shawl to which the prior art pertains is made of a fur material alone and so, it is very expensive. Also while seeming luxurious, it is nevertheless poorly ventilated and it is likely to become dirty owing to dust, sweat and so on.

SUMMARY OF THE INVENTION

It is the object of the present invention to provide a fur shawl which is well-ventilated and inexpensive, and furthermore, which is easily manufactured, for example by sewing.

BRIEF DESCRIPTION OF THE DRAWING

The present invention may best be understood by reference to the following description, taken in conjunction with the accompanying drawing in which.

DETAILED DESCRIPTION OF THE INVENTION

Figure 1:
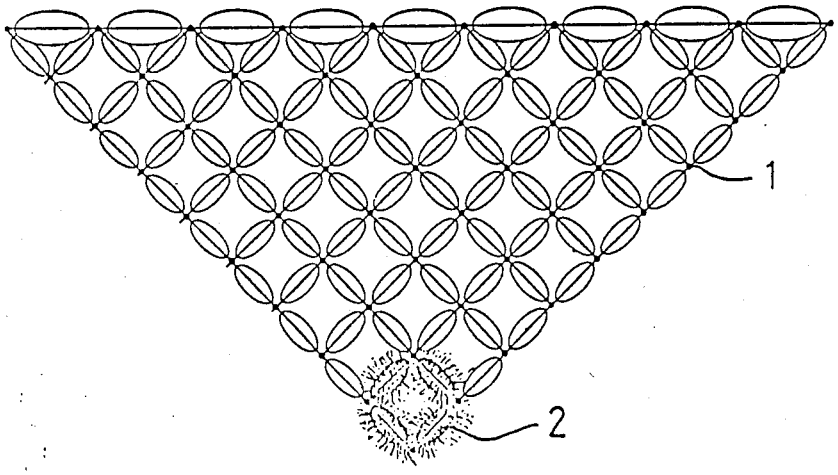
FIG. 1 is a partially schematic plan view of a fur shawl constructed from the present invention.

Referring to FIG. 1, the present invention is a fur shawl, wherein each piece of fur material 2 is rolled around the sides of the quadrangles formed by a net 1 (into which a string may be knitted) with the pieces of fur material 2 sewn by thread not shown in FIG. 1 to form said fur shawl.

Figure 2:
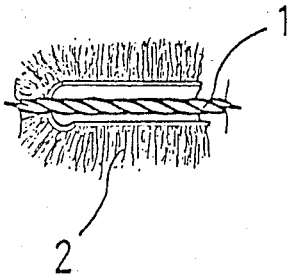
FIG. 2 is an explanatory view illustrating that the fur material has been sewn up around one side of a net in a tubular shape, securing said fur material to one side of a net quadrangle.

FIG. 2 illustrates how the fur material 2 is rolled and sewn up around a side of the net 1, forming a tubular shape.

Figure 3:
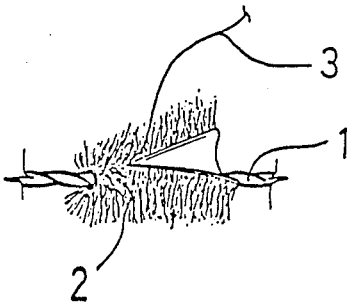
FIG. 3 is an explanatory view illustrating a process in which the fur material is being sewn up around one side of a net quadrangle.

FIG. 3 depicts a process wherein the fur material 2 is being sewn up around a side of the net 1 with a thread 3, securing it onto the net 1, with the seam parallel to the string around which the fur is rolled.

In the above case, the fur material is affixed to all four sides of the quadrangles formed by the net, it is left to the maker's discretion whether the fur material pieces are rolled and sewn up around one, two, three, or four sides of quadrangles of the net, or whether these are sewn in regular or irregular patterns. Accordingly, many kinds of fur coverings can be made.

With respect to the fur material pieces, they may be from a new fur cut into pieces of a size to be suitable for sewing in accordance with the invention. But, even waste pieces from cutting furs which are thrown away in the past become a good fur material and so, production costs may be decreased considerably.

This fur shawl is well-ventilated, as there are numerous spaces created by the net structure. Also it gives a comfortable feeling to user, since the net structure allows for play, giving elasticity. Particularly the production cost can be decreased considerably, since waste pieces from cutting furs, which were thrown away in the past, can be utilized as the fur material.

I claim:

1. A fur shawl, comprising a fur material member rolled around each of a plurality of side elements forming a net, said fur material members being sewn up around each side element of said net with sewing thread whereby said fur material members are united to form a body.

2. A fur material comprising a plurality of legs joined together to form a substantially planar matrix, each of said legs having first and second ends, at least a portion of said legs joining with at least two other legs at one of their ends whereby at least three legs extend from a node, a plurality of fur material members disposed around at least a portion of said legs whereby fur material of joined fur elements is formed.

3. A fur material as in claim 2 wherein said legs are made of a flexible material.

4. A fur material as in claim 3 wherein said flexible material is string or rope.

5. A fur material as in claim 2 wherein said fur material members are disposed on said legs in a regular pattern.

6. A fur material as in claim 2 wherein said fur material members are disposed in an irregular pattern.

7. A fur material as in claim 2 wherein fur material members are disposed around every leg.

8. A fur material as in claim 2 wherein only a portion of said legs have fur material disposed over them.

9. A fur material as in claim 2 wherein said leg form a regular polygonal matrix having a length and a breadth.

10. A fur material as in claim 2 wherein said legs are made of string, and said fur material is disposed around every leg, said legs being arranged in a polygonal formation to form a substantially planar flexible covering.

11. A method of making a fur covering, comprising the steps of forming a flexible string-like material into a polygonal matrix having a length and a breadth and securing fur material members around the legs of the polygonal matrix using a thread, said fur members being secured in sufficient numbers to insure a substantial covering of said polygonal matrix with fur.

* * * * *